United States Patent [19]

Hayashi

[11] 4,312,742

[45] Jan. 26, 1982

[54] PROCESS FOR THE PRODUCTION OF A PETROLEUM PITCH OR COKE OF A HIGH PURITY

[75] Inventor: Kiyoshige Hayashi, Tokyo, Japan

[73] Assignee: Hi-Max Ltd., Tokyo, Japan

[21] Appl. No.: 150,431

[22] Filed: May 16, 1980

[30] Foreign Application Priority Data

May 29, 1979 [JP] Japan ..... 54-65558

[51] Int. Cl.[3] ..... C10G 57/00; C10G 9/14

[52] U.S. Cl. ..... 208/50; 208/131

[58] Field of Search ..... 208/50, 131

[56] References Cited

U.S. PATENT DOCUMENTS

| | | | |
|---|---|---|---|
| 2,775,549 | 12/1956 | Shea, Jr. | 208/50 |
| 2,871,182 | 1/1959 | Weekman, Jr. | 208/50 |
| 2,963,416 | 12/1960 | Ward | 208/50 |
| 3,817,853 | 6/1974 | Folkins | 208/50 |
| 4,177,133 | 12/1979 | Hayashi | 208/50 |

*Primary Examiner*—T. M. Tufariello

*Attorney, Agent, or Firm*—Larson and Taylor

[57] ABSTRACT

A petroleum pitch or coke of a high purity is produced from a petroleum heavy residue such as distillation and cracked residua, asphalt and pitch by such treatment of the residue prior to a conventional pitching or coking treatment that the residue is treated with hydrogen in the absence of a catalyst under a hydrogen pressure of 20~200 Kg/cm$^2$ under a gradual heating up to a final temperature of 350°~400° C. so as to heat the residue from 150° C. to 300° C. over 30 to 120 minutes and then from 300° C. to the final temperature over 10 to 60 minutes. The non-catalytic hydrogen treatment is called "hydrogenation refining step", which gives a refined pitching/coking feedstock from which a petroleum pitch or coke of extra high purity is derived.

8 Claims, 1 Drawing Figure

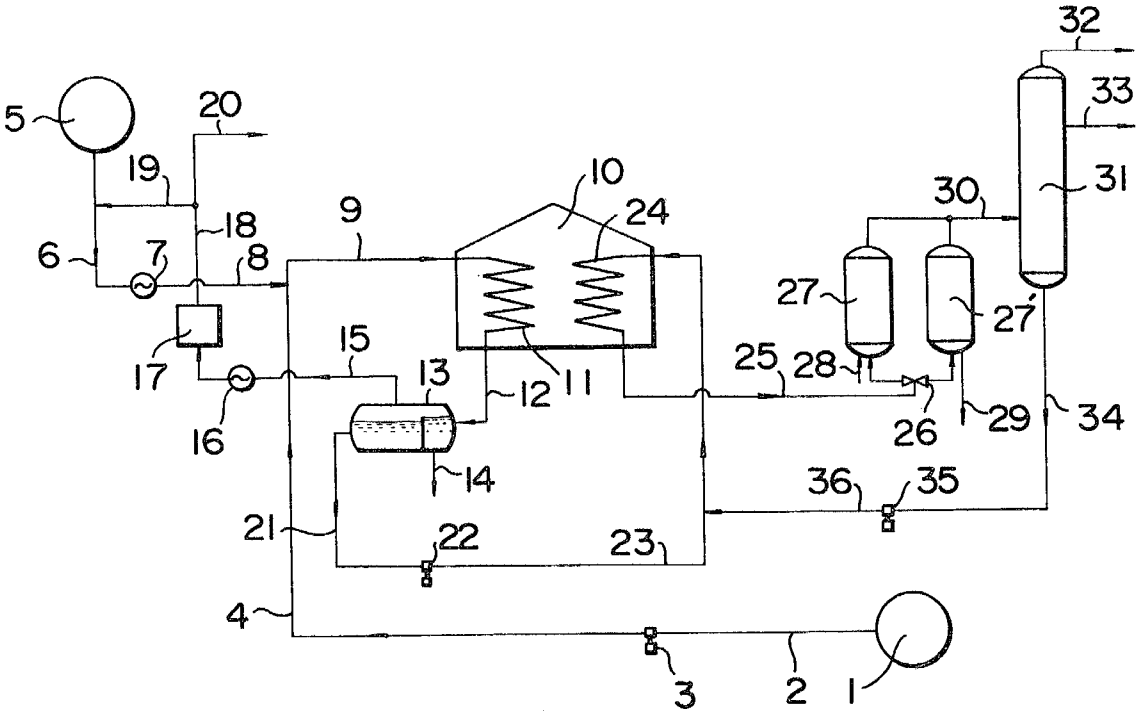
32
33
31
34
27'
29
30
26
35
27
28
36
25
1
2
3
24
10
11
12
23
14
13
22
9
15
21
4
20
18
8
16
19
7
17
5
6

PROCESS FOR THE PRODUCTION OF A PETROLEUM PITCH OR COKE OF A HIGH PURITY

TECHNICAL FIELD OF THE INVENTION

This invention relates to a process for the production of a petroleum pitch or coke of a high purity from a petroleum heavy residue by a non-catalytic hydrogen treatment followed by a pitching/coking treatment.

BACKGROUND OF THE INVENTION

Carbon is a material having excellent mechanical strengths, particularly at high temperatures and is widely used as a number of carbonaceous products in many applications such as a reducing agent for iron industry, electrode for electric furnace smelting, jet nozzle for rocket and core material for nuclear reactor. Recently, with rapid progress of atomic energy industry and aeronautical and cosmic technology, requirements for properties of carbonaceous products have become more and more severe.

Pyrolysis tars which are formed as by-products in a high temperature cracking of petroleum distillates such as naphtha and gas oil to produce ethylene and other olefins and acetylenes, e.g. those of so called "ethylene tar bottoms", contain a high proportion of polycyclic aromatic hydrocarbons and are conveniently used as raw materials of carbonaceous products. A disadvantage of such a pyrolysis residue is to absorb oxygen in the air even at room temperatures, which prevents such aromatic hydrocarbons from being further polycondensed into large crystals of a graphite structure. Therefore, it is impossible to produce a high quality needle-like coke directly from the pyrolysis residua. The production of a needle-like coke from coal origins is more difficult than that from petroleum residua because a substantial amount of oxygen is inevitably present during mainly the carbonization step of coal due to impossibility of complete shutting off of oxygen from the system.

In general, the heating of asphalt or pyrolysis tar bottoms eventually results in the formation of a solid coke due mainly to the polycondensation reaction of polycyclic aromatics. A polarized microscopic view at room temperature of samples, for the purpose of observation of the course during which the asphalt or tar bottoms initially in a liquid state under heating is gradually changed into a solid coke, shows that the heating up to about 300° C. of the material gives a homogeneous phase only, but that the heating up to about 400° C. gives a variety of spherical phases wherein smaller- and larger-sized spheres are intermingled together. When continuing the heating of the material up to about 450° C., there is observed a well-developed stripe-pattern existing in a stratiform in the larger spheres which becomes needle-like structure when heated to 1,400° C. The larger spheres gradually grow at 400°–450° C. whereby to integrate together to form much larger spheres with the growth of stratified stripe-structure which is visible by the naked eye if heated at 1,400° C. In contrast, the smaller spheres are observed on the microscope not to grow further and not to integrate together or with the larger spheres, but to leave as they are and to disperse in the spaces between, and on the surface of, the larger spheres and whereby to prevent the larger spheres from growing into much larger ones. With a high content of such smaller spheres, the coke derived therefrom has no needle-like structure, but a black-sooty appearance when calcined at 1,400° C., possibly because the smaller spheres are being dispersed in the coke in the form of small sooty particles as such.

An intermingled phase of smaller- and larger-sized spheres which appears when asphalt or pyrolysis tar is heated to a temperature of around 400° C. and which is not completely solidified yet is called "mesophase". In fact, in that state, the smaller particles have been substantially solidified, whereas the larger particles almost not yet solidified, so that the latter itself is really worthy to call mesophase. This is, however, not general in the related art. Similarly, the intermingled phase as above-mentioned is called "an insoluble phase" for a number of years in the art (see, for example, U.S. Pat. No. 2,775,549 to F. L. Shea, Jr.). In fact, the formability and behavior of such smaller- and larger-sized spheres will largely depend on the nature of the starting materials, but the smaller spheres are generally liable to be formed at temperatures lower than those at which the larger spheres are formed. Thus, as a rule, the smaller spheres appear in the materials at around 350° C. and the larger spheres start to be formed at around 400° C. Hereinafter, I refer to the smaller spheres as "impure mesophase" and the larger spheres as "pure mesophase".

My experiences on coke formation suggest that the higher the contents of oxygen-containing impurities in starting petroleum heavy residue, the larger the formation of the smaller spheres. For example, a topped residue from Djatibarang crude oil, if heated to a temperature around 350° C. for several hours, deposits a large amount of a sludgy solid phase therein due to the formation of such smaller spheres, whereas the residue from Minas crude oil does not give rise to such phenomenon. Further, the former emits a slight phenol-like odor upon being subjected to a hydrogenation, which is evidence of the presence of oxygen-containing impurities therein. The fact that the presence of such oxygen-containing impurities in a petroleum residue, if the latter is coked, would prevent the coke so formed from being so grown as to form polycondensates of graphitized structure with larger crystal sizes can be clearly appreciated by such observation on a polarized microscope of a product obtained by heating the residue at 450° C. for 1 hour that impure mesophase comprising fine sooty carbonaceous particles much prevails against pure mesophase comprising larger carbonaceous spheres in an unstable, disordered structure. A sufficient growth of pure mesophase would result in the formation of dense, mechanically strong coke particles which would be converted to a graphitized form with compact lattice structure which has a low coefficient of thermal expansion. In contrast, the higher the content of impure mesophase in the material, the lower the degree of growth of pure mesophase with the decrease in the compact lattice spacing of the resulting graphitized coke, the lower the mechanical strength of the coke product and the higher the coefficient of thermal expansion thereof. Therefore, in order to make possible the production of carbonaceous products resistant to, and stable under, their working conditions which are now becoming more and more severe, it is essential to subject only pure mesophase to coking, i.e. polycondensation, by previously removing impure mesophase from the starting material even in a trace residual amount.

Various attempts have been made to remove impure mesophase from coking materials. Thus, among many methods proposed therefor, one method is based on such discovery that impure mesophase is easier to be polycondensed than pure mesophase and carbonized at temperatures as low as 350°~400° C. and comprises heat-treating a coking material, i.e. a petroleum heavy residue, so as to preferentially polycondense the impure mesophase, separating the impure mesophase thus polycondensed from the pure mesophase by flash distillation so as to remove the former as pitch at the bottom of the flashing column and to recover the latter as distillate at the top of the column for coking (refer to K. Hayashi et al., U.S. Pat. No. 4,177,133). Another method for the removal of impure mesophase is to treat a coking material with activated clay or zeolite at 300°~400° C. so as to adsorb easily carbonizable impure mesophase preferentially on the surface of the said treating agent (refer to U.S. Pat. No. 2,775,549 above-cited, for example). This method has such disadvantage that the complete separation of solid particles of clay, etc. from the material is difficult and thus the quality of the product, coke, is rather lowered. There are other methods based on catalytic hydrogenation of a coking material, the catalyst being platinum or molybdenum deposited on an alumina or activated carbon as carrier, where impure mesophase is hydrogen-refined (for example, refer to K. Hayashi; A Fundamental study on a Process of Manufacture for High Purity Coke, Annual Report 1978 of Coal Research Institute, Faculty of Engineering, Hokkaido University, Japan, page 67). These methods also involve a difficulty in the separation of catalyst particles.

H. O. Folkins has recently proposed in U.S. Pat. No. 3,817,853 that the coking of pyrolysis tars can be improved to give an improved yield of distillate product and a reduced yield of coke with a higher quality of the coke if the pyrolysis tars are pretreated prior to coking by a hydrogenation treatment. Although the hydrogenation treatment is generally disclosed to be capable of effecting in the presence or absence of a catalyst, there is no contrete disclosure at all about embodiments of non-catalytic hydrogenation. Further, the Folkins' U.S. patent shows that the hydrogenation is effected at mild conditions at temperatures from 250° F. to about 800° F. (i.e. 120° to 427° C.), preferably from 375° to 600° F. (i.e. 190° to 316° C.) at a pressure of from 100 to about 1,500 psig (i.e. about 7~105 Kg/cm$^2$G), preferably of from about 200 to about 1,000 psig (i.e. about 14~70 Kg/cm$^2$G), so as to consume approximately 100 to about 2,000, preferably 300 to 1,000 cubic feet of hydrogen per barrel of pyrolysis tar feedstock. Experiments in Example 1 of the Folkins' U.S. patent suggest without doubt that the hydrogenation of said process does not adopt a gradual heating procedure, but is carried out by passing the feedstock to a fixed bed catalyst maintained at a predetermined temperature, namely at 550° F. (288° C.) in Experiment No. 1 and at 750° F. (399° C.) in Experiment No. 2 with such results that Experiment No. 1 gives a much lower yield of coke with a significantly higher quality thereof than those of Experiment No. 2.

BRIEF SUMMARY OF THE INVENTION

I have now surprisingly found that the hydrogenation of unsaturated double bonds in polycyclic aromatic compounds and the removal of oxygen-, sulfur- and nitrogen-containing impurities contained in petroleum heavy residue to be utilized for coking can be achieved simultaneously and effectively by a non-catalytic hydrogenation refining under new, controlled conditions. This invention is based on this discovery and provides a new and useful process for the production of a petroleum pitch or coke of a high purity from a petroleum heavy residue by taking such a non-catalytic hydrogenation refining as a pretreatment followed by pitching/coking treatment.

According to this invention, therefore, there is provided a process for the production of a petroleum coke or pitch of a high purity from a petroleum heavy residue which comprises pretreating the residue with hydrogen gas in the absence of a catalyst under a hydrogen pressure of about 20~200 Kg/cm$^2$ and under a gradual heating up to a final temperature of about 350°~400° C. so as to heat the residue from about 150° C. to about 300° C. over 30 to 120 minutes and then from about 300° C. to the final temperature over 10 to 60 minutes; transferring the residue thus treated into a settler to liberate the hydrogen gas remained and to remove a precipitated mass containing impurities, if any, from the residual oil; and heat-soaking the residual oil thus separated in a manner known per se for pitching/coking petroleum hydrocarbons.

Throughout the specification, the pressure shown is a gauge pressure unless otherwise specified.

DETAILED DESCRIPTION OF THE INVENTION

A petroleum heavy residue which may be used as starting material in the process of this invention may be any of heavy residue derived from refining processes including a distillation residue, cracked residue, asphalt and pitch.

In the first step, i.e. the hydrogenation refining step, according to this invention, a petroleum heavy residue is treated with hydrogen gas in the absence of a catalyst under such specific conditions as above stated, whereby there are obtained such unexpected results that olefinic double bonds contained can be easily hydrogenated so as to decrease the final content of olefinically unsaturated materials to 2~3% or at most several percent by weight, that sulfur-, nitrogen- and oxygen-containing impurities can be effectively removed, both substantially during the heating up to about 300° C., and further that polycondensation of polycyclic aromatics vigorously occurs with the liberation of hydrogen during the heating above 300° C. Thus, according to this invention, the choice and control of the temperature conditions in the hydrogenation refining as above-specified are the most important to attain the desired effects. There have been observed in my experiments such phenomena that the absorption of hydrogen into the starting material usually starts at around 150° C., and more often around 170°~180° C., depending upon particular starting material, proceeds substantially at around 250° C. to about 300° C. with the increase in the reaction speed and that with continuing further heating above 300° C. under the same conditions, dehydrogenation also occurs vigorously in the presence of hydrogen. In view of the fact that there occurs no formation of smaller spheres below 300° C. even if a substantial amount of impure mesophase is present in the starting material as above-mentioned, the fact that the absorption of hydrogen becomes substantial up to 300° C. in the non-catalytic hyrogenation according to this invention means that the hydrogenation of most of olefinic double bonds and the removal of sulfur-, nitrogen- and oxygen-containing impurities can be effectively achieved before the formation of impure mesophase is initiated. Then, by a further continuation of the non-catalytic hydrogenation under further heating above 300° C., dehydrogenation and polycondensation reactions actively proceed in the presence of hydrogen, but it is important and essential to stop these reactions before pure mesophase contained therein is pitched or coked. Thus, the optimum final temperature for the non-catalytic hydrogenation step is to be determined within the range of 350°~400° C. dependent upon the nature of starting material and hydrogenation conditions.

The residence time for the hydrogenation refining step may be appropriately determined depending upon the nature of starting material and temperature conditions chosen in each particular case. Thus, in a preferred embodiment according to this invention which will be detailed later, the inlet and outlet temperatures of a tube heater to be used for effecting said hydrogenation treatment are appropriately set, then the temperature gradient for said heater is chosen as desired whereby the residence time for the particular material to be treated therethrough can be determined. For example, under a hydrogen pressure of 40~60 Kg/cm$^2$ [hydrogen gas/-starting material (volume ratio calculated in terms of atmospheric temperature and pressure) about 50~100 l/l], the total residence time will preferably be about 60~120 minutes for a distillation residue (from 150° to 300° C. over 40~80 minutes, and from 300° C. to the final temperature over 20~40 minutes) and about 40~90 minutes for ethylene tar bottoms (from 150° to 300° C. over 30~60 minutes, and from 300° C. to the final temperature over 10~30 minutes).

To sum up, the essential feature of the hydrogenation refining step of this invention resides in a non-catalytic hydrogenation under a hydrogen pressure of 20~200 Kg/cm$^2$ and under a gradual heating comprising the first half from about 150° C. to about 300° C. for 30 to 120 minutes and the latter half from about 300° C. to a final temperature between about 350° C. and 400° C. for about 10 to 60 minutes. In the first half heating, there preferentially occurs hydrogenation reaction resulting in hydrogen-refining and the latter half heating mainly involves dehydrogenation reaction resulting in polycondensation of polyaromatics. It is important to note that no satisfactory result intended by this invention can be obtained unless both the former half and the latter half heatings are conducted as specified above. This is clearly demonstrated by referring to Example 1 and Comparative Example 1 given later.

A remarkable advantage or feature of this invention is that the overall amount of hydrogen consumed during the hydrogenation refining step is much less than the amount required theoretically from the bromine value of the starting material at normal temperature and pressure conditions. Thus, the hydrogen consumption is only 7~18 cc/g of starting material in actual determinations, whereas the theoretical calculation shows the amount of hydrogen required to be about 50~60 cc/g for ethylene tar bottoms as starting material.

After the completion of the hydrogenation refining step, the material thus treated is transferred to a settling tank to liberate the hydrogen gas remained and to remove a precipitated mass containing impurities, if any, from the treated oil through the bottom of the tank.

The treated oil thus obtained is then transferred from the settler to the subsequent pitching/coking step where the oil is preferably treated in a delayed manner. Thus, the oil leaving the settler is preheated in a coking preheater under a pressure of 2~50 Kg/cm$^2$ to a temperature of about 400°~430° C. for pitching or of about 430°~470° C. for coking and then introduced into a pitching/coking drum in a manner known per se. The pitching/coking may be effected by heat-soaking the oil in the drum under a pressure of 2~50 Kg/cm$^2$ at a temperature of about 400°~470° C. specified above until a pitch/coke as desired is produced while a small amount of hydrogen, steam or an inert gas is continuously blown upwards through the drum. The residence time in the pitching/coking drum may vary depending upon the nature of the object product, nature of the oil treated and pitching/coking conditions, but generally may be about 1~20 hours for the production of pitch and about 20~54 hours for the production of coke. The pitching/coking drum to be used may be any of those conventionally employed for coking such as those for delayed coking. The pitching/coking material may be introduced into a pitching/coking drum either upwardly from the bottom or downwardly from the top of the drum.

For purpose of producing a pitch, an alternative method can be employed, wherein the oil recovered from the hydrogenation refining step is subjected to a vacuum distillation to recover the pitch as vacuum residuum. In this case, the vacuum distillates are also of a high aromatics content, which is then subjected to a standard catalytic hydrogenation to yield a high boiling aromatics of a high purity at a low cost.

The pitch and coke thus obtained according to this invention had a high purity and a high polycondensed-aromatics content. Thus, the pitch is most useful as binder for carbon electrodes and other carbonaceous materials and is expected to be suitable as material for the manufacture of carbon fibers, whereas the coke is of a high crystalline structure with a high orientation and evaluated as the highest grade of graphitizable coke.

Some consideration is now given on the results obtained according to this invention which are unexpectedly superior to those so far obtained and which are due to the non-catalytic hydrogenation refining step effected prior to the pitching/coking. For example, when ethylene tar bottoms having a specific gravity of 1.0873, a sulfur content of 0.06% by weight and a bromine number of 42 g/100 g and containing 21.7% by weight of olefins and paraffins and 51.9% by weight of aromatics and dienes are subjected to non-catalytic hydrogenation refining according to this invention, there is obtained an oily product having a specific gravity of 1.08~1.09, a sulfur content of 0.03~0.02% by weight and a bromine number of 7 g/100 g and containing 2~4% by weight of olefins and 63~76% by weight of aromatics. This increase in the aromatics content is mainly attributed to the hydrogenation onto olefinic double bonds in side chains of polycyclic aromatic compounds.

The amount of hydrogen required theoretically for the saturation of olefinic double bonds present in the ethylene tar bottoms above-mentioned which is hereinafter referred to as theoretical hydrogen amount may be calculated from the bromine number of 42 to be 58.6 cc per gram of the ethylene tar bottoms under NTP. In contrast therewith, the amount of hydrogen absorbed actually to the ethylene tar bottoms during the overall hydrogenation refining step according to this invention can be calculated to be 13.7~16.2 cc per gram of the ethylene tar bottoms by gathering the factors of hydrogen conditions at the inlet and outlet of the step, i.e. concentration, gas/liquid ratio, volume of gases, pressure and temperature. Therefore, the actual hydrogen consumption for this step amounts to only about one-fourth of the theoretical hydrogen amount. It has suprisingly been found that notwithstanding such a low hydrogen consumption, the ethylene tar bottoms thus treated have a bromine number of 7, a content of olefinic unsaturation of about 2~4% by weight and a sulfur content of about 0.02~0.03% by weight. With respect to the content of oxygen-containing impurities, it was difficult for me to detect the oxygen contents by any direct analysis, but there was certainly suggested a substantial removal of oxygen-containing impurities by such observation that a burning smell inherent to ethylene tar bottoms disappeared and instead some aromatics-like smell could be caught.

A considerable decrease in the olefin content has also been observed in coker gasoline fraction which was derived as a distillate in the subsequent pitching/coking step. Thus, the olefin content of this coker gasoline was only about 0.7~1.0% by weight, whereas that of coker gasoline directly derived from the ethylene tar bottoms without being hydrogenated was about 10~25% by weight.

Thus, according to this invention, there are obtained coker gasoline and coker gas oil having as low as 1% of olefin content as coker distillates, which are then subjected to a rather slight catalytic hydrogenation to yield a solvent or material for organic synthesis of a high aromatics content such as those having an aromatics content of about 96% by weight and a sulfur content of less than 0.1%. On the contrary, when the starting heavy residue is directly coked without being previously subjected to the hydrogenation refining, both the coker gasoline and coker gas oil each contain a substantial amount of olefins, e.g. 15~20% by weight of olefins in case of ethylene tar bottoms used as starting material, and it is therefore necessary to adopt a standard, expensive catalytic hydrogenation with a hydrogen consumption of about 40~60 cc/g to produce high boiling aromatics of a high purity.

It is believed, although the reaction mechanism is not yet elucidated, that the characteristic main reaction involved in the non-catalytic hydrogenation refining step according to this invention is dehydrocondensation in the presence of hydrogen. Thus, in the initial stage of the hydrogenation refining, hydrogen absorption is predominant, where polycyclic aromatics which are of relatively low molecular weight and which are considered to be monomers from which are derived pitch and coke of much larger molecular weight absorb hydrogen on the end-ring portions thereof to form naphthenic rings due to the presence of hydrogen. Such hydrogen absoprtion occurs substantially at temperatures up to 300° C. Then, the resulting naphthenic ring portions of the polycyclic aromatics are condensed with each other at higher temperatures, i.e. above about 300° C. so that the polycyclic aromatics are grown more and more to give higher molecular weight compounds of the same nature with the liberation of hydrogen. The hydrogen once liberated is then absorbed similarly on the end ring portions of growing polycyclic aromatics to form naphthenes of higher molecular weight ultimately to minimize olefinic unsaturation.

Further, according to the hydrogenation refining of this invention, sulfur, oxygen and nitrogen contained as impurities in various forms, even though they are not completely removed from the reaction systems, are prevented from entering into, and being integrated to, the structure of complicated, macromolecular condensates of polycyclic aromatics due to the presence of hydrogen, whereby high molecular weight polycyclic aromatics with a high purity, that is a high quality pitch and coke having a high graphitizability with high orientation, can be obtained ultimately.

BRIEF DESCRIPTION OF THE DRAWING

The drawing shows a simplified schematic flow diagram of a representative embodiment of this invention.

DESCRIPTION OF THE PREFERRED EMBODIMENTS

Referring to the drawing, a combination furnace 10 is provided with a heating tube 11 for the hydrogenation refining and heating tube 24 for the pitching/coking step. These heating tubes may be provided, separately, as desired. The starting material, a petroleum heavy residue, stored in a tank 1 is pumped by a pump 3 through lines 2 and 4. Hydrogen gas stored in a hydrogen tank 5 is passed through lines 6 and 8 by means of a compressor 7. The starting material and hydrogen gas are then combined together on line 9 and the combined stream is introduced into the heating tube 11, wherein the mixture is subjected to non-catalytic hydrogenation refining under a gradual heating up to a final temperature of 350°~400° C. at a pressure of 20~200 Kg/cm$^2$, the heating being conducted from about 150° to 300° C. for 30 to 120 minutes and then from about 300° C. to the final temperature for 10 to 60 minutes. The residence time in the hydrogenation refining step can be controlled as desired in such a manner that a soaking section of an appropriate size is set at the outlet end portion of the heating tube 11. The material thus treated is then transferred to a settling tank 13 through line 12. The settling tank 13 is provided with a line 14 at the bottom thereof for the removal of a precipitated mass, if any, and a line 15 at the top thereof for the removal of the liberated hydrogen gas. The hydrogen gas thus separated is passed through a blower 16 into a scrubber 17 for the removal of hydrogen sulfide therefrom and then sent to a recycle line 19 or a discharge line 20 through line 18. The treated oil is discharged from the settler 13 by means of a pump 22 through lines 21 and 23 and, after it is combined with a recycled oil which is derived from the bottom of a main fractionating column 31 by means of a pump 35 through lines 34 and 36, introduced into a heating tube 24 for pitching/coking step, wherein the oil is heated up to a temperature required for the subsequent pitching/coking operation, namely about 400°~430° C. for the purpose of pitching or about 430°~470° C. for the purpose of coking. The oil thus preheated is then introduced into a pitching/coking drum 27 through line 25, wherein the oil is maintained under conditions of a temperature of about 400°~470° C. and a pressure of 2~50 Kg/cm$^2$ as required until a sufficient amount of pitch or coke is formed and accumulated therein, while a minimum amount of a heated purging gas such as hydrogen, steam or an inert gas such as nitrogen or gaseous hydrocarbon is continuously introduced into the drum 27 through line 28. Usually, the time required for maintaining the oil in the drum 27 is about 1~20 hours for the purpose of pitching and about 20~54 hours for the purpose of coking. In the embodiment shown, two pitching/coking drums 27 and 27' are arranged in parallel which are to be used alternately in a delayed manner by the operation of a switching valve 26. The product, pitch or coke, thus accumulated is discharged at the bottom of drum through line 29. The overhead product of the pitching-/coking drum, i.e. coker distillate, is discharged at the top of drum through line 30 and introduced into the main fractionating column 31 at the middle or lower position thereof, where gas and gasoline appear in line 32, gas oil appears in line 33 and a heavy residue is discharged by means of a pump 35 through line 34 and recycled to line 23 for pitching/coking step through line 36.

The following Examples further illustrate, but not limit, this invention, in which percentages given are by weight unless otherwise stated.

EXAMPLE 1

There was used, as starting heavy residue, ethylene tar bottoms obtained by a high temperature thermal cracking of naphtha, the properties of which are as follows:

| | |
|---|---|
| Specific gravity (15°/4° C.) | 1.0873 |
| Sulfur content (wt %) | 0.06 |
| Bromine number (g/100 g) | 42 |
| Elution chromatographic analysis (wt %) | |
| Olefins and paraffins | 21.7 |
| Aromatics and dienes | 51.9 |
| Resins | 0.8 |
| Others | 25.6 |

The starting oil was mixed with hydrogen gas to give a volume ratio of hydrogen/starting oil under atmospheric temperature and pressure conditions of 50/1 and the mixture was introduced into a heating tube for the hydrogenation refining step, wherein the oil was subjected to hydrogenation refining under gradual heating up to the final outlet temperature of 380° C. and under a pressure of 40 Kg/cm$^2$. The temperature and time conditions during this step were from 150° C. to 300° C. for 32 minutes and from 300° to 380° C. for 18 minutes. Then, the reaction mixture was transferred to a settling tank to liberate the hydrogen unreacted and to recover the oil thus treated. The amount of hydrogen absorbed was 13.7 cc/g, whereas the theoretical amount of hydrogen required for the ethylene tar bottoms having a bromine number of 42 was 58.6 cc/g as above-mentioned, so that the former corresponds to only 23.4% of the latter.

The properties of the oil thus hydrogen-treated are as follows:

| | |
|---|---|
| Specific gravity (15°/4° C.) | 1.0852 |
| Sulfur content (wt %) | 0.03 |
| Bromine number (g/100 g) | 7 |
| Elution chromatography (wt %) | |
| Olefins and paraffins | 4.1 |
| Aromatics and diens | 65.1 |
| Resins | 0.9 |
| Others | 29.9 |

The oil was then introduced into a heating tube for delayed coking to preheat the oil up to a temperature of 450° C. at the outlet under a pressure of 5 kg/cm$^2$ and then transferred to a coking drum maintained at an internal temperature of 435° C. under a pressure of 5 Kg/cm$^2$, while hydrogen gas was introduced upwardly into the drum in an amount approximately equal to that of the oil introduced (calculated in terms of atmospheric pressure at 100° C.). After the operation was continued for 35 hours, steam at 440° C. was passed through the drum to expel the remaining oil and the green coke thus formed was recovered. The yields of coke and coker distillate were 33.9% and 60.9%, respectively.

The green coke thus obtained had a volatile matter content of 7.1%. When calcined at 1,400° C. for 3 hours, the coke had a weight loss of 9.13%, a sulfur content of 0.10% and a crushing strength of 65%.

The graphitization of the calcined coke as it was at 3000° C. for ½ hours gave a graphitized coke of much more developed graphite structure than that of the highest grade one derived from a two-stage delayed coking. Thus, the graphitized coke obtained had a maximum transverse magnetoresistance measured at 10 Kgauss in liquefied nitrogen of 83%, a minimum transverse magnetoresistance measured under the same conditions of 2%, the (max./min.) ratio of 41.5, whereas a graphitized coke of the highest grade had maximum and minimum ones of 34% and 18%, respectively and the (max./min.) ratio of 1.9.

The graphitization of the same calcined coke as above, but in the form of an electrode rod, under the same conditions gave a graphitized coke having a maximum transverse magnetoresistance of 30%, a coefficient of thermal expansion (CTE) over 100°~400° C. of $0.63\times10^{-6}$/°C. and a coefficient of cubic expansion (CCE) over 100°~400° C. of $6.20\times10^{-6}$/°C.

The coker distillate recovered as overhead from the coking drum with a yield of 60.9% had a specific gravity (15°/4° C.) of 1.0003. The coker distillate was fractionated into a fraction boiling up to 250° C. and a fraction boiling above 250° C. The lower-boiling, i.e. gasoline, fraction was in a yield of 55.1% and had a composition by volume of 96.9% aromatics, 0.7% olefins and 2.4% paraffins and naphthenes. The higher-boiling fraction was in a yield of 44.9% and had a composition analyzed by elution chromatography of 0.8% paraffins and olefins, 96.2% aromatics and diens, 0.6% resins and 2.4% others.

Each of the lower-boiling (250° C.−) and higher-boiling (250° C.+) fractions thus obtained is subjected to a conventional catalytic hydrogenation in the presence of a platinum supported on alumina gel as catayst under usual conditions of a temperature between 200° and 300° C. and a pressure between 5 and 50 atmospheres, yielding a colorless, transparent high-boiling aromatic hydrocarbons containing more than 98% by volume of aromatics, less than 0.1% by volume of olefins and less than 0.1% by weight of sulfur.

COMPARATIVE EXAMPLE 1

(1) The procedure used in Example 1 was repeated except that the hydrogenation refining step was effected to omit the latter-half, i.e. in such a manner that the gradual heating was carried out from 150° C. to 300° C. for 32 minutes, after which the reaction mixture was transferred into the settling tank.

The coke derived therefrom in a graphitized rod form had a maximum transverse magnetoresistance of 21% and a CTE of $1.0\times10^{-6}$/°C.

(2) The procedure used in Example 1 was repeated except that the hydrogenation refining step was effected in such a manner that the starting mixture was rapidly heated up to 300° C. over 5 minutes and then gradually heated up to 380° C. over 25 minutes, after which the reaction mixture was transferred into the settling tank.

The coke derived therefrom in a graphitized rod form had a maximum transverse magnetoresistance of 16 and a CTE of $1.1\times10^{-6}$/°C.

(3) The procedure used in Example 1 was repeated except that the hydrogenation refining step was completely omitted, that is the starting oil was directly coked.

The coke thus obtained, when calcined at 1400° C. for 3 hours, had a sulfur content of 0.43% and a crushing strength of 54%. Graphitization of the calcined coke in the form of an electrode rod at 3000° C. for 30 minutes gave a graphitized product having a maximum transverse magnetoresistance of 12%, a CTE (100°~400° C.) of $1.23\times10^{-6}$/°C. and a CCE (100°~400° C.) of $8.46\times10^{-6}$/°C.

EXAMPLE 2

The starting heavy residue used in this Example was a vacuum residue derived from a vacuum distillation of Djatibarang topped crude, which had the following properties.

| | |
|---|---|
| Specific gravity (15°/4° C.) | 0.914 |
| Sulfur content (%) | 0.19 |
| Asphaltene content (%) | 19.0 |
| Conradson's carbon residue (%) | 20.0 |

The starting oil was mixed with hydrogen gas to give a volume ratio of hydrogen/starting oil under atmospheric temperature and pressure conditions of 50/1 and the mixture was introduced into a heating tube for the hydrogenation refining step, wherein the mixture was gradually heated up to the final outlet temperature of 390° C. under a pressure of 40 Kg/cm$^2$. The temperature and time conditions during this step were from 150° to 300° C. for 50 minutes and from 300° to 390° C. for 30 minutes. Then, the reaction mixture was transferred to a settling tank to liberate the hydrogen unreacted, to remove 2% of a precipitated matter and to recover the oil thus hydrogen-treated.

The oil recovered was preheated in a coking heater to a temperature of 450° C. at the outlet thereof under a pressure of 5 Kg/cm$^2$ and introduced into a coking drum maintained at an internal temperature of 435° C. under a pressure of 5 Kg/cm$^2$, while hydrogen gas was passed upwardly through the drum in the same manner as that described in Example 1. After the operation was continued for 35 hours, the green coke and coker distillate formed were recovered in a usual manner. The products recovered were 18% coke, 15% coker gas, 22% coker gasoline and 45% coker gas oil.

The coke obtained had a volatile matter content of 10%. When calcined at 1400° C. for 3 hours, the coke had a sulfur content of 0.20% and a crushing strength of 62%. Graphitization of the calcined coke as it was at 3000° C. for 30 minutes gave a graphitized coke having a maximum transverse magnetoresistance of 50%. When the calcined coke was graphitized in the form of an electrode rod under the conditions same as above, the graphitized product had a maximum transverse magnetoresistance of 25%, a CTE (100°~400° C.) of $1.00\times10^{-6}$/°C. and a CCE (100°~400° C.) of $7.2\times10^{-6}$/°C.

The coker gasoline obtained above had a composition of 5% olefins, 80% aromatics and 15% paraffins and naphthenes. The coker gas oil had a composition of 9% olefins, 81% aromatics and 10% resins and others.

COMPARATIVE EXAMPLE 2

The Djatibarang vacuum residue same as that used in Example 2 was used as starting material and directly subjected to a delayed coking without the hydrogenation refining step according to this invention. Thus, the starting material alone, i.e. in the absence of hydrogen, was passed through the heating tube for hydrogenation refining step used in Example 2 to merely heat the material up to 400° C. at the outlet thereof, provided that the feeding of the material was stopped before the occurrence of clogging of the heating tube with a deposited mass. The material was then transferred into the settling tank wherein a substantial amount of a precipitated mass was deposited and separated therefrom as an amorphous coke-like material in an amount of about 10% based on the weight of the starting material fed. The oil recovered from the settling tank, which had a sulfur content of 0.21%, was coked in the same manner and under the same conditions as those used in Example 2 to yield 15% coke, 14% cracked gas, 23% coker gasoline and 46% coker gas oil.

The coke thus obtained had a volatile matter content of 10%. When calcined at 1400° C. for 3 hours, the coke had a sulfur content of 0.36% and a crushing strength of 56%. Graphitization of the calcined coke as it was at 3000° C. for 30 minutes gave a graphitized coke having a maximum transverse magnetoresistance of 32%. When the calcined coke was graphitized in the form of an electrode rod under the conditions same as above, the graphitized product had a maximum transverse magnetoresistance of 18%, a CTE (100°~400° C.) of $1.50\times10^{-6}$/°C. and a CCE (100°~400° C.) of $8.9\times10^{-6}$/°C.

The coker gasoline obtained above had a composition of 20% olefins, 57% aromatics and 23% paraffins and naphthenes. The coker gas oil had a composition of 21% olefins, 60% aromatics and 19% resins and others.

EXAMPLE 3

The starting heavy residue used in this Example was a vacuum residue derived from a vacuum distillation of Minas topped crude, which had the following properties.

| | |
|---|---|
| Specific gravity (15°/4° C.) | 0.920 |
| Sulfur content % | 0.20 |
| Asphaltene content % | 14.5 |

The starting oil was treated in accordance with the same procedure as that used in Example 2 except that the final temperature for the hydrogenation refining step was 400° C. and that the temperature and time conditions for this step were from 150° to 300° C. for 70 minutes and from 300° C. to 400° C. for 30 minutes. In this case, there was found little amount of precipitated matters in the settling tank. Sulfur content of the oil discharged from the settling tank was lowered to 0.06%. The products recovered from the coking step were 16% coke, 14% coker gas, 20% coker gasoline and 45% coker gas oil.

The coke, when calcined at 1400° C. for 3 hours, had a sulfur content of 0.19% and a crushing strength of 60%. Graphitization of the calcined coke as it was at 3000° C. for 30 minutes gave a graphitized coke having a maximum transverse magnetoresistance of 65%. When the calcined coke was graphitized in the form of an electrode rod under the conditions same as above, the graphitized product had a maximum transverse magnetoresistance of 28%, a CTE (100°~400° C.) of $0.80\times10^{-6}$/°C. and a CCE (100°~400° C.) of $6.8\times10^{-6}$/°C.

The coker gasoline obtained above had a composition of 6% olefins, 78% aromatics and 16% paraffins and naphthenes. The coker gas oil had a composition of 10% olefins, 80% aromatics and 10% resins and others.

COMPARATIVE EXAMPLE 3

The Minas vacuum residue same as that used in Example 3 was used as starting material and directly subjected to a delayed coking without the hydrogenation refining step according to this invention. Thus, the starting material alone, i.e. in the absence of hydrogen, was passed through the heating tube for hydrogenation refining step used in Example 3 to merely heat the material up to 400° C. at the outlet thereof, provided that the feeding of the material was stopped before the occurrence of clogging of the heating tube with a deposited mass. The material was then transferred into the settling tank, wherein there was deposited little amount of precipitated mass. The oil recovered from the settling tank was coked in the same manner and under the same conditions as those used in Example 3 to yield 15% coke, 16% cracked gas, 23% coker gasoline and 46% coker gas oil.

The coke thus obtained, when calcined at 1400° C. for 3 hours and then graphitized as it was at 3000° C. for 30 minutes, had a maximum transverse magnetoresistance of 32%. When the calcined coke was graphitized in the form of an electrode rod under the same conditions as above, the graphitized product had a maximum transverse magnetoresistance of 25%, a CTE (100°~400° C.) of $1.2\times10^{-6}$/°C. and a CCE (100°~400° C.) of $7.4\times10^{-6}$/°C.

The coker gasoline obtained above had a composition of 20% olefins, 60% aromatics and 20% paraffins and naphthenes. The coker gas oil had a composition of 22% olefins, 62% aromatics and 16% resins and others.

EXAMPLE 4

This Example illustrates the preparation of a pitch of a high quality according to this invention. Thus, a portion of the oil which was treated in the hydrogenation refining step of Example 1 and recovered from the settling tank was subjected to a vacuum distillation to leave a pitch as distillation bottoms in the yield of 35% based on the oil fed to the vacuum distillation. The resulting pitch had the following properties.

| | |
|---|---|
| Specific gravity (15°/4° C.) | 1.305 |
| Conradson's carbon residue (%) | 54 |
| Softening point (°C.) | 90 |
| Benzene insolubles (%) | 33 |
| Quinoline insolubles (%) | 10 |

This pitch was tested as binder pitch to be used for the preparation of a graphite electrode from a petroleum coke in comparison with a coal pitch conventionally used as such binder pitch, and with a pitch derived as distillation bottoms of a vacuum distillation of the ethylene tar bottoms same as that used in Example 1, both as controls. The properties of these pitches as controls are as follows:

| Nature of pitch used | Coal pitch | Pitch derived directly from ethylene tar bottoms |
|---|---|---|
| Specific gravity (15°/4° C.) | 1.313 | 1.143 |
| Conradson's carbon residue (%) | 53 | 35 |
| Softening point (°C.) | 87 | 72 |
| Benzene insolubles (%) | 32 | 0.6 |
| Quinoline insolubles (%) | 10 | 0.0 |

A sample electrode rod was prepared from the coke obtained in Example 1 above with the use of each of the three pitches above-mentioned. Thus, the coke, after calcined, was pulverized and the resulting coke grist (100 parts by weight comprising 40 parts of 35~60 mesh and 60 parts of 100 mesh~) was well mixed with the pitch used (30 parts by weight) at 170° C. and the mixture was extruded through a hydraulic extruder to form an extruded rod of 20 mm in diameter and 200 mm in length. The green extrudate was packed in carbon powder and slowly baked up to 1500° C. The baked artefact was then graphitized at 3000° C. for 30 minutes to form a graphite artefact.

The properties of each sample electrode rod in the form of the baked artefact and graphite artefact are given below.

| | Prepared by this invention | Control 1 derived from coal | Control 2 derived from ethylene tar bottoms |
|---|---|---|---|
| baked artefact | | | |
| Bulk density g/cc | 1.60 | 1.55 | 1.38 |
| Bending strength Kg/cm$^2$ | 237 | 190 | 120 |
| Specific resistance Ω cm | 4.02 | 4.41 | 5.81 |
| Graphite artefact | | | |
| Maximum transverse magnetroresistance % | 32 | 30 | — |
| CTE (100°~400° C.) × $10^{-6}$/°c. | 0.60 | 0.63 | — |
| CCE (100°~400° C.) × $10^{-6}$/°C. | 6.00 | 6.20 | — |

What I claim is:

1. A process for the production of a petroleum coke or pitch of a high purity from a petroleum heavy residue which comprises pretreating the residue with hydrogen gas in the absence of a catalyst under a hydrogen pressure of about 20–200 kg/cm$^2$ and under a gradual heating up to a final temperature of about 350°–400° C. so as to heat the residue from about 150° C. to about 300° C. over 30 to 120 minutes with prevalent occurrence of hydrogenation reaction and then from about 300° C. to the final temperature over 10 to 60 minutes with prevalent occurrence of dehydrogenation and polycondensation reactions; transferring the residue thus treated into a settler to liberate the hydrogen gas remained and to remove a precipitated mass containing impurities from the residual oil; and heat-soaking the residual oil thus separated until a desired amount of a petroleum coke or pitch of a high purity is formed.

2. The process of claim 1 wherein the petroleum heavy residue is a distillation residue, cracked residue, asphalt or pitch.

3. The process of claim 1 wherein the petroleum heavy residue is ethylene tar bottoms and the pretreatment with hydrogen is effected in the absence of a catalyst under a hydrogen pressure of about 40~60 Kg/cm$^2$ under such gradual heating as from about 150° C. to about 300° C. over 30 to 60 minutes and from about 300° C. to the final temperature over 10 to 30 minutes.

4. The process of claim 1 wherein the petroleum heavy residue is a distillation residue and the pretreatment with hydrogen is effected in the absence of a catalyst under a hydrogen pressure of about 40 to 60 Kg/cm$^2$ under such gradual heating as from about 150° C. to about 300° C. over 40 to 80 minutes and from about 300° C. to the final temperature over 20 to 40 minutes.

5. The process of claim 1 wherein the heat-soaking of the residual oil pretreated with hydogen is effected at a temperature of 400°–430° C. under a pressure of 2–50 Kg/cm$^2$ until a desired amount of a pitch of a high purity is formed.

6. The process of claim 1 wherein the heat-soaking of the residual oil pretreated with hydrogen is effected by a vacuum distillation to form a pitch of a high purity as vacuum bottoms.

7. The process of claim 1 wherein the heat-soaking of the residual oil pretreated with hydrogen is effected by a delayed coking.

8. The process of claim 7 wherein the delayed coking is effected at a temperature of 430°–470° C. under a pressure of 2–50 Kg/cm$^2$ until a desired amount of a coke of a high purity is formed.

* * * * *